United States Patent [19]

Holmes

[11] 4,263,867

[45] Apr. 28, 1981

[54] BOAT ANCHOR

[76] Inventor: Huntly S. Holmes, 103B, Dexter, Me. 04930

[21] Appl. No.: 17,821

[22] Filed: Mar. 5, 1979

[51] Int. Cl.[3] ..... B63B 21/46

[52] U.S. Cl. ..... 114/299; 114/304; 114/309

[58] Field of Search ..... 114/299, 301, 298, 304, 114/309, 310

[56] References Cited

U.S. PATENT DOCUMENTS

| | | | |
|---|---|---|---|
| 2,722,191 | 11/1955 | Johnson | 114/299 |
| 3,557,739 | 1/1971 | Kaercher | 114/299 |
| 3,894,474 | 7/1959 | Donaldson | 114/299 |

*Primary Examiner*—Sherman D. Basinger

*Attorney, Agent, or Firm*—Prutzman, Kalb, Chilton & Alix

[57] ABSTRACT

A double fluke anchor having a pair of flukes lying in a common plane is welded to a crossbar. An elongated stock projecting forwardly of the flukes at right angles to the crossbar and lying in the plane of the flukes is journaled on the crossbar for limited relative rotation. The forward end of the stock is fixed to the forward end of a hairpin shank having its widest dimension at an intermediate point, approximately in the plane of the pivot of the cross bar and converging toward both ends to form a closed loop. A sliding ring connects the anchor line and the hairpin shank and is freely slidable to both ends of the hairpin shank. With this construction, the anchor may be weighed with the flukes lying adjacent the axis of the hairpin shank with the tips of the flukes pointed downwardly.

1 Claim, 5 Drawing Figures

BOAT ANCHOR

This invention relates to boat anchors and is particularly concerned with anchors of the double fluke type which are of light weight simple construction, have increased holding power and anti-fouling characteristics and are easy to retrieve and store.

Small craft anchors are generally of the double fluke design with the flukes lying in a single plane and pivoted for a limited rotary movement with respect to a shank so that they may dig into the bottom of a body of water to anchor the boat. Normally, these anchors are a compromise between the amount of holding power which they may develop and the ease of retrieving the anchor after set in soft bottoms.

It is among the objects of the present invention to provide a double fluke anchor which will set deeply to provide maximum holding power but is nonetheless easily retrieved from a mud bottom, or if caught under a log, cable, stone or the like.

Another object is to provide such an anchor which will automatically reset itself effectively when the wind or tide shifts while the boat is at anchor.

A further object of this invention is to provide an improved anchor which can be retrieved without bringing mud, weeds, and debris from the bottom.

Other objects will be in part obvious and in part pointed out more in detail hereinafter.

A better understanding of the invention will be obtained from the following description and the accompanying drawing of an illustrative application of the invention.

Figure 1:
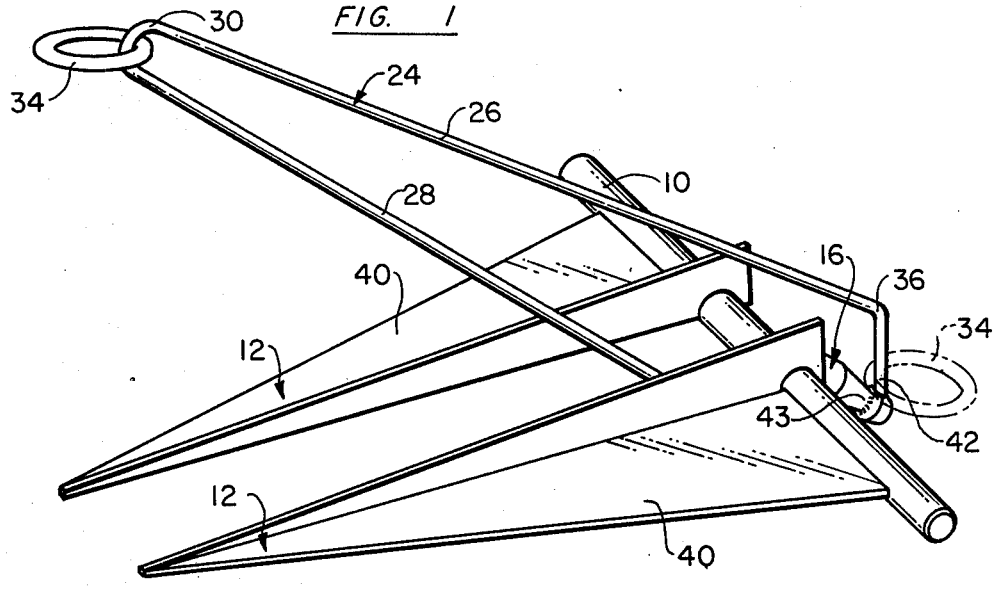
FIG. 1 is a perspective view of a double fluke anchor embodying the invention.

Referring to the drawings in detail, the anchor of the present invention includes a cylindrical cross bar or shaft 10 to which a pair of flukes 12 having tips lying in the same plane are welded. The cross bar 10 is pivotally mounted, or journaled, in an aperture 14 of stock 16 for limited relative rotation, the amount of which is determined by a stop pin 18 fixed to cross bar 10 and positioned in a radial slot 20 formed in the rear end of the stock 16. As shown in the drawings, the other end of stock 16 is fixedly secured to shank 24 as by welding.

The shank 24 is generally formed as a closed loop having arms 26, 28 which diverge rearwardly from its juncture with stock 16 to their widest dimension, located approximately in the plane through the pivot axis of the cross bar 10, and then converge toward its rear end 30 which is shown as extending further rearwardly than of the tips of the flukes 12.

Figure 2:
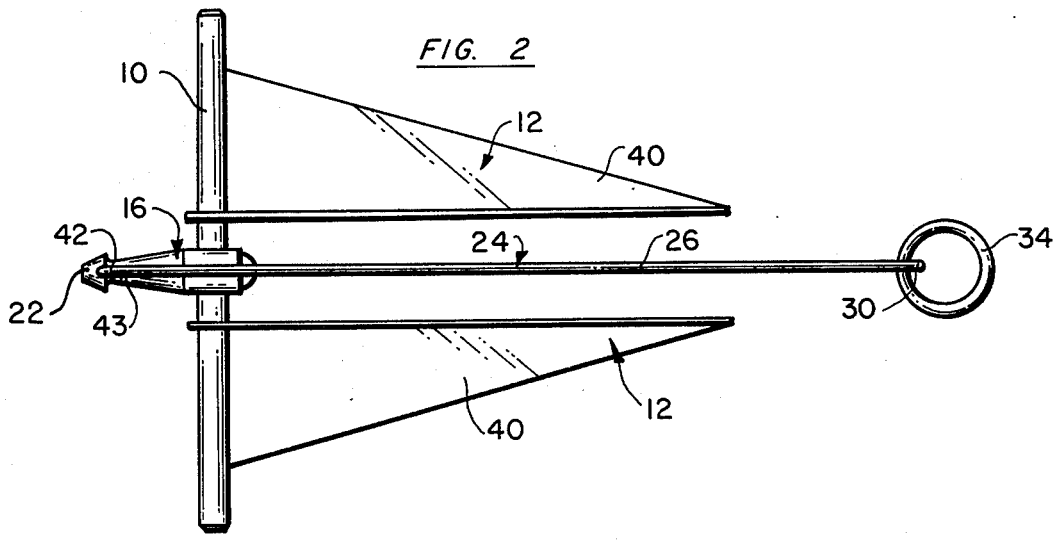
FIG. 2 is a top view thereof.
Figure 3:
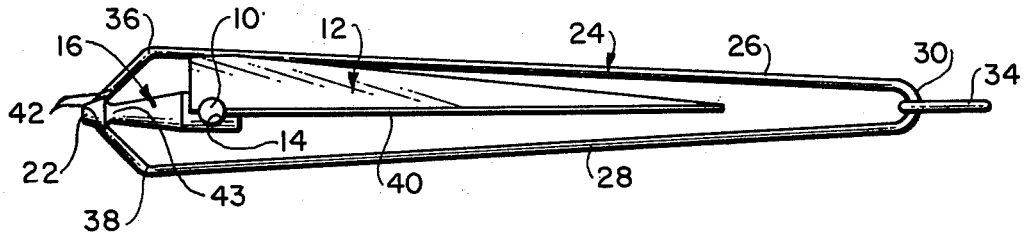
FIG. 3 is a side view thereof.
Figure 4:
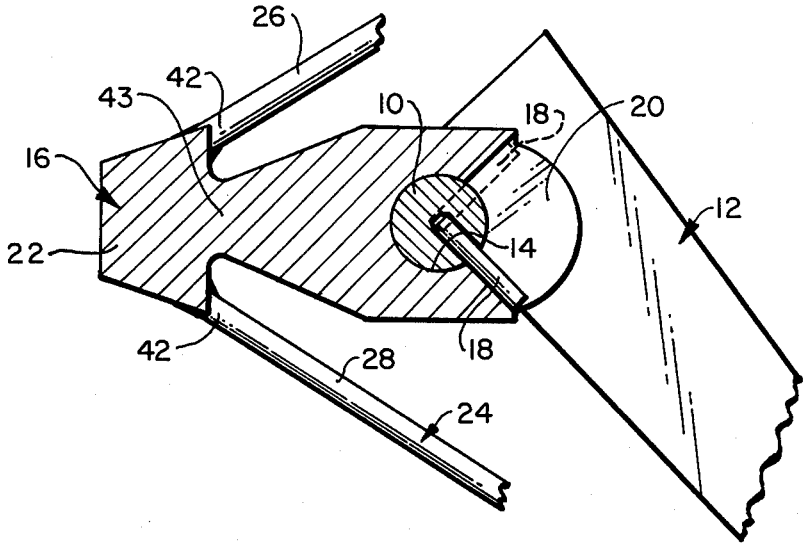
FIG. 4 is an enlarged fragmentary cross-sectional view showing the pivot connection between the flukes and the shank.

As shown in FIG. 2, the stock 16 projects forwardly of and at right angles to the cross bar 10 and in the same plane as the spaced arms 26, 28.

Figure 5:
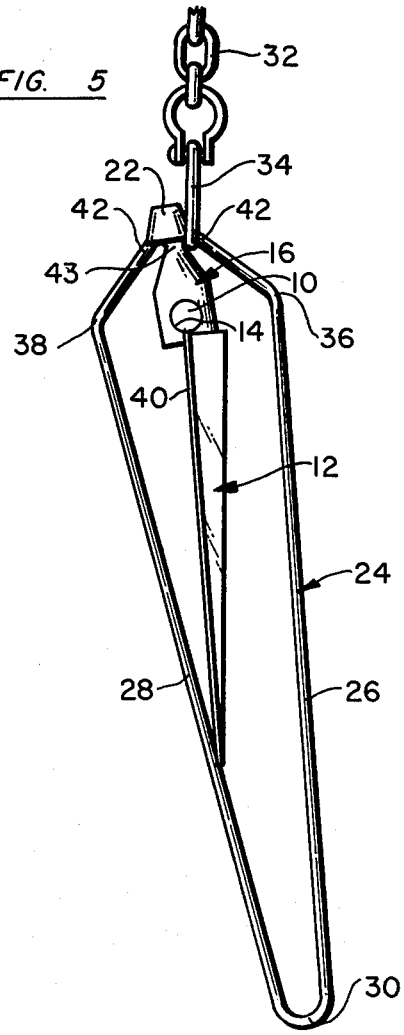
FIG. 5 is a side view showing the anchor in its storage position.

When the anchor is stored, it may be stored with the tips of the flukes 12 pointed downwardly as shown in FIG. 5, and dropped into the water with the tips pointed downwardly as the mooring line is payed out. When the rear end 30 of the hairpin shank 24 engages the bottom, the flukes 12 will swing out in one direction and the tips of the flukes will engage the bottom approximately at right angles to minimize the possibility that seaweeds, debris, and the like may foul the anchor as it is being set. Also, this provides the maximum weight for causing the flukes to begin to dig into the mud or sand at the bottom before mooring tension is applied to the mooring line.

As additional mooring line is payed out to provide the desired scope for a secure anchorage, the anchor chain 32 will drop to the bottom and cause the sliding ring 34 to move to the rear end 30 of the shank 24 so that when the boat applies a tension on the anchor due to the force of wind or tide, the anchor will be firmly set in the bottom.

In order to retrieve the anchor, the boat may be moved toward and over the anchor while taking up the slack in the mooring line. As the boat passes over the anchor, the sliding ring 34 slides along one side of the hairpin shank 24 at least until it reaches one of the most widely spaced points 36, 38 so that a pull on the mooring line will cause the flukes to be pulled out of the mud substantially along the plane of their flat bases 40 so that the removal is effective with minimal force. Moreover, such removal will cause the mud and debris on the bottom to be sheared off as the flukes are released from the bottom.

It will also be apparent that this will assure that the anchor can be retrieved even though it has snagged under roots, rocks, or other debris on the bottom.

Because of the ease of retrieval of the anchor, the stop pin 18 and slot 20 may be constructed to permit the flukes to swing a greater angle, say 45°, on either side of the axis of stock 16 so as to dig into the bottom more deeply without unduly increasing the force needed to retrieve the anchor. Thus, the holding power of the anchor may be increased.

As the anchor is pulled aboard the boat, the points of the flukes are pointed downwardly so that the water will wash the surfaces of the flukes so that a clean anchor, free from mud and debris is returned to the boat. Moreover, by virtue of the fact that the stock extends forwardly of the pivot point of the cross bar 10, the sliding ring will move to the end 42 of the shank 24 very close to the center line of the stock 16, as shown in FIG. 5. This will result in aligning the flukes approximately with the axis of hairpin shank 24 so that the risk of hitting the hull of the boat with the tips of the flukes is substantially reduced even though the anchor is lifted aboard very close to the hull.

Preferably the stock is necked down as shown at 43 so that the axis of stock 16 may be positioned as close as possible to the plane of the flukes 12 as the anchor is retrieved.

The anchor of the invention will also automatically reset itself in the event that the boat swings over the anchor due to a shift in current or tide while it is at anchor.

Under such conditions, the sliding ring 34 moves to the front end 42 of the shank 24 beyond the pivot axis of the cross bar 10 to release the anchor from the bottom as described above. Thereafter, any movement of the anchor along the bottom will cause the hairpin shank 24 to flip over and then cause the flukes to flip over in the opposite direction so that fluke tips again engage the bottom and dig in cleanly. Thus, the anchor resets itself upon changes of wind or tide minimizing the possibility that the anchor will foul on weeds and debris and drag along the bottom as sometimes occurs where the anchor cannot reset itself but rotates the flukes in the bottom during a reversal of the position of the boat relative to the anchor.

As will be apparent to persons skilled in the art, various modifications, adaptations and variations of the foregoing specific disclosure can be made without departing from the teachings of the present invention.

I claim:

1. A double fluke anchor comprising a pair of flukes rigidly connected to a crossbar, an elongated stock having one end journaled on said crossbar for limited relative rotation, said elongated stock projecting forwardly of said flukes at right angles to the crossbar and defining a first plane therewith, a hairpin shank generally forming a closed loop with the arms thereof converging from its widest dimension located intermediate the ends of said closed loop to the junctures of the arms forming the ends of the hairpin shank, the hairpin shank lying in a second plane perpendicular to the first plane and being rigidly connected to the other end of the elongated stock at the juncture of the arms forming the forward end of said hairpin shank, said other end of said elongated stock being necked down in said first and second plane to have a dimension at its connection with said hairpin shank less than its dimension at its end journaled to said crossbar, and a sliding ring connected to said hairpin shank and being freely slidable therealong, said ring engaging said elongated stock and the forward juncture of the arms of the hairpin shank when the anchor is weighed with said sliding ring at the forward end of said hairpin shank, whereby the sliding ring is positioned substantially on the axis of the hairpin shank during the weighing of the anchor and gravity forces substantially align the flukes with the axis of the hairpin shank.

* * * * *